US006402402B1

(12) United States Patent
Suzuki et al.

(10) Patent No.: US 6,402,402 B1
(45) **Date of Patent: *Jun. 11, 2002**

(54) PRESSURE-SENSITIVE AND HEAT-SENSITIVE IMAGE TRANSFER APPARATUS FOR RECORDING

(75) Inventors: Minoru Suzuki, Tochigi; Hiroshi Orita; Hiroyuki Saito, both of Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/615,907

(22) Filed: Jul. 13, 2000

Related U.S. Application Data

(63) Continuation of application No. 09/228,974, filed on Jan. 12, 1999, now Pat. No. 6,109,800.

(30) Foreign Application Priority Data

Jan. 13, 1998 (JP) ..... 10-018171

(51) Int. Cl.[7] ..... B41J 2/32; B41J 2/325

(52) U.S. Cl. ..... 400/120.02; 400/241.2; 400/241.4; 347/173; 347/212

(58) Field of Search ..... 400/120.01, 120.02, 400/241.2, 120.04, 237, 241, 241.1; 347/172, 173, 212; 428/321.5

(56) References Cited

U.S. PATENT DOCUMENTS

| | | | | |
|---|---|---|---|---|
| 4,399,209 A | | 8/1983 | Sanders et al. | 430/138 |
| 4,440,846 A | | 4/1984 | Sanders et al. | 430/138 |
| 4,527,171 A | * | 7/1985 | Takanashi et al. | 101/470 |
| 4,644,376 A | | 2/1987 | Usami et al. | 503/215 |
| RE33,525 E | * | 1/1991 | Kohashi | 347/212 |
| 5,104,767 A | | 4/1992 | Nakamura | 430/138 |
| 6,106,173 A | | 8/2000 | Suzuki et al. | 400/120.02 |
| 6,109,800 A | * | 8/2000 | Suzuki et al. | 400/120.02 |

FOREIGN PATENT DOCUMENTS

| | | | |
|---|---|---|---|
| JP | 61-137787 A | * | 6/1986 |
| JP | 62-80078 A | * | 4/1987 |
| JP | 1-110979 | | 4/1989 |
| JP | 1-202496 A | * | 8/1989 |
| JP | 2-92549 A | * | 4/1990 |
| JP | 4-4960 | | 1/1992 |
| JP | 4-85047 | | 3/1992 |
| JP | 4-122667 A | * | 4/1992 |
| JP | 5-8565 | | 1/1993 |
| JP | 5-64903 | | 3/1993 |

* cited by examiner

*Primary Examiner*—Daniel J. Colilla
(74) *Attorney, Agent, or Firm*—Greenblum & Bernstein, P.L.C.

(57) ABSTRACT

A pressure-sensitive and heat-sensitive recording apparatus has a pre-coating container that pre-coats a recording sheet prior to a printing operation on the recording sheet. The pre-coating material container, ribbon cassette and an over-coating material container are provided in a recording head, while being movable in a printing direction lead by the pre-coating material container. The printed color-image is protected by an over-coating material dispensed from the trailing over-coating material container.

15 Claims, 9 Drawing Sheets

(a)

(b)

PRESSURE-SENSITIVE AND HEAT-SENSITIVE IMAGE TRANSFER APPARATUS FOR RECORDING

This is a continuation of U.S. patent application Ser. No. 09/228,974, filed Jan. 12, 1999, now U.S. Pat. No. 6,109, 800, the contents of which are expressly incorporated by reference herein in its entirety.

BACKGROUND OF THE INVENTION

1. Field of the Invention

The present invention relates to an image transfer apparatus used in a high-resolution printer for pressure-sensitive and heat-sensitive recording of an image on a recording sheet, and more particularly for recording the image by locally pressing and selectively heating recording material that includes capsules.

2. Description of the Related Art

A printing solution is known that includes fine capsules, such as micro-capsules, filled with heat-sensitive color developing dye or ink for high-resolution printing in a high-resolution color printer. A recording sheet consists of a base sheet with a layer of the micro-capsules covering the base sheet. The layer of micro-capsules includes a plurality of types of micro-capsules, each type corresponding to a specific color ink or dye, which is seeped from the micro-capsule onto the recording sheet when the corresponding micro-capsule is heated to a predetermined temperature. The predetermined temperature varies dependent on the type of micro-capsule. Each seeped color ink or dye is developed and fixed by light of a predetermined wavelength, which also varies depending on the type of micro-capsule. Therefore, each type of micro-capsule seeps a predetermined color ink or dye when heated to the predetermined temperature, and the seeped color ink or dye is developed and fixed on the recording sheet by irradiation with the light of the specific wavelength. Thus, color development of a full-color image, to be recorded on a recording sheet, can be controlled through selection of the micro-capsules to seep the dye or ink, which occurs through control of localized heating and irradiation with a specific wavelength of light.

The recording process utilizing the recording sheet with the layer of the micro-capsules is complicated and time-consuming because the localized heating and light irradiation must be repeatedly executed in order to develop and fix a plurality of colors. When the recording sheet is a normal sheet of plain paper, it becomes difficult to record a high-resolution image on the sheet, because the normal paper usually has an uneven printing surface.

SUMMARY OF THE INVENTION

Therefore, an object of the present invention is to provide a pressure-sensitive and heat-sensitive image transfer apparatus for easily recording a full-color high-resolution image on a recording sheet through controlled localized pressure and temperature application, regardless of a surface condition of the recording sheet.

An image transfer apparatus according to the present invention comprises an ink transfer unit that includes a layer of micro-capsules containing dye, each micro-capsule disposed in the layer of micro-capsules exhibits a temperature/pressure characteristic such that, when each micro-capsule is squashed under a corresponding predetermined pressure at a corresponding predetermined temperature, dye seeps from the squashed micro-capsule and transfers to a surface of a recording sheet. A pressure application unit is also included that locally applies the corresponding predetermined pressure to the micro-capsule layer, and a heat application unit is included that selectively and locally heats the micro-capsule layer to the corresponding predetermined temperature. A pre-coating unit that pre-coats a material on the surface of recording sheet prior to transfer of dye is also included, wherein a degree of roughness of the surface of the recording sheet is diminished due to the material, such that the transferred dye is accurately fixed to the surface as the image.

Preferably, the resin of the shell wall is a shape memory resin, which exhibits a glass-transition temperature corresponding to the corresponding predetermined temperature, and the shape memory resin of the shell wall comprises a predetermined thickness.

Preferably, the image transfer apparatus includes an ink transfer storage unit that stores the ink transfer unit, and a holder that holds the ink transfer unit and the pre-coating unit. Also preferably, the image transfer apparatus includes an ink transfer storage unit that stores the ink transfer unit and the pre-coating unit, and a holder that holds the ink transfer storage unit. The pre-coating material may be a liquid or a film fixable to the surface of the recording sheet.

Further, the image transfer apparatus may include an over-coating unit that over-coats a material on the surface of the recording sheet subsequent to transfer of the dye, wherein transferred dye is permanently fixed and protected on the surface. Furthermore, the over-coating material protects the transferred dye against at least one of damaging electromagnetic radiation, oxidation, discoloration and fading.

An image transfer apparatus according to the present invention comprises a conveyor unit that intermittantly transports a recording sheet in a transport direction; a recording head that records the image line by line on a surface of the recording sheet by moving in a recording direction substantially perpendicular to the transport direction. The recording head includes an ink-transfer ribbon that comprises a base member and a layer of micro-capsules, coated over the base member, that contains a plurality of micro-capsules filled with dye, each micro-capsule of the plurality of micro-capsules exhibits a temperature/pressure characteristic such that, when each micro-capsule is squashed under a corresponding predetermined pressure at a corresponding predetermined temperature, the dye discharges from the squashed micro-capsule and transfers to the surface of the recording sheet. The image transfer apparatus further comprises a temperature application unit that selectively and locally heats the layer of micro-capsules to the corresponding predetermined temperature, a pressure application unit that locally applies the corresponding predetermined pressure to the layer of micro-capsules, and a pre-coating material container, positioned downstream of the recording direction, that pre-coats a material on the surface of the recording sheet prior to the discharge of the dye, wherein a degree of roughness of the surface of the recording sheet is diminished due to the material such that the transferred dye is accurately fixed to the surface.

Preferably, the image transfer apparatus includes an over-coating material container, positioned upstream of the recording direction, that over-coats a material on the surface of the recording sheet subsequent to the transfer of the dye, such that the transferred dye is permanently fixed and protected on the surface.

Preferably, the recording head reciprocally records the image line by line on the surface of the recording sheet by alternately moving in the recording direction prior to the intermittant movement and opposite the recording direction subsequent to the intermittant movement.

An image transfer apparatus according to the present invention comprises an ink transfer unit that includes a layer of micro-capsules containing dye, each micro-capsule disposed in the layer of micro-capsules exhibits a temperature/pressure characteristic such that, when each micro-capsule is squashed under a corresponding predetermined pressure at a corresponding predetermined temperature, the dye seeps from the squashed micro-capsule and transfers to a surface of a recording sheet. A pressure and heat application unit is also included that applies localized the corresponding pressure and selectively localized predetermined heat to the micro-capsule layer, the predetermined heat includes heating to the corresponding predetermined temperature. A pre-coating unit that pre-coats a material on the surface of the recording sheet line by line prior to the transfer of the seeped dye is also included, wherein a degree of roughness of the surface of the recording sheet is diminished due to the material, such that the transferred dye is accurately fixed to the surface as the image.

BRIEF DESCRIPTION OF THE DRAWINGS

The present invention will be better understood from the description of the preferred embodiments of the invention set third below together with the accompanied drawings, in which:

FIG. 4 (*b*) is a cross-sectioned elevational view showing an over-coating material container of the first embodiment;

DESCRIPTION OF THE PREFERRED EMBODIMENT

Hereinafter, the preferred embodiments of the present invention are described with reference to the attached drawings.

Figure 1:
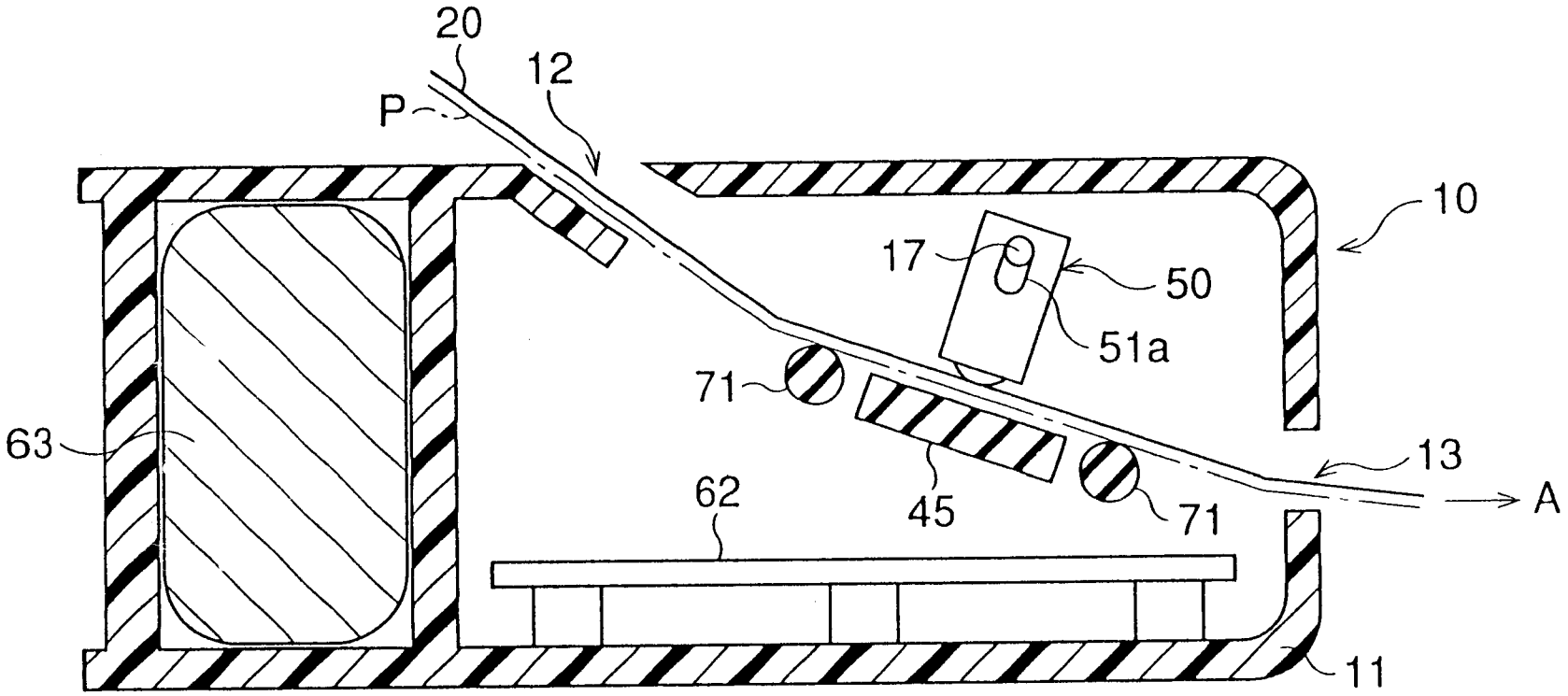
FIG. 1 is a cross-sectioned elevational view showing a high-resolution color printer of a first embodiment for pressure-sensitive and heat-sensitive recording.

FIG. 1 is a cross-sectioned elevational view of a high-resolution color printer 10 for pressure-sensitive and heat-sensitive recording of a full-color image on a recording sheet 20.

The color printer 10 is a serial printer comprising a housing 11, which is rectangular parallelepiped in a longitudinal direction ("line direction", hereinafter) being perpendicular to a longitudinal direction of the recording sheet 20, a recording head 50, a horizontal platen 45 and conveyer rollers 71. An inlet slit 12 is provided on an upper surface of the housing 11 for inserting the recording sheet 20, which is a normal sheet of plain paper, and an outlet slit 13 is provided on a side surface of the housing 11. The recording sheet 20 passes along a conveyer path P, shown by a single-chained line, from the insert slit 12 to the outlet slit 13.

The recording head 50 is movably supported by a guide rail 17 that extends in the line direction above and perpendicular to the conveyer path P within the housing 11. The recording head 50 is fixed to a portion of a head-conveying belt (not shown), such as a well-known endless belt exhibiting elasticity, which is wound around two rollers (not shown). One roller is synchronous with another roller which is intermittantly rotated by a motor (not shown), so that the head-conveying belt conveys the recording head 50 in the line direction. The recording head 50 is provided with a bearing 51*a* through which the guide rail 17 is slidably received, so that the recording head 50 is movably supported by the guide rail 17 in a direction perpendicular to the line direction, thus enabling the recording head 50 to contact with and retract from a recording surface of the recording sheet 20. The recording head 50 is driven in the direction perpendicular to the line direction by a solenoid (not shown). This is a well-known method for conducting line movement of the recording head 50, and as such is not described or illustrated in greater detail herein.

The horizontal platen 45 has a rectangular shape and is positioned under the path P in the housing 11, with longitudinal sides of the horizontal platen 45 extending in the line direction beyond a maximum width of the recording sheet 20, and in accordance with a required lateral movement of the recording head 50 along the guide rail 17 in the line direction. The conveyer rollers 71 are positioned in parallel in the line direction adjacent longitudinal sides of the horizontal platen 45.

The conveyer rollers 71 are driven by a drive motor (not shown), such as a stepping motor, or the like, in a clockwise direction (in FIG. 1), so that the sheet is intermittently transported downstream from the inlet slit 12 to the outlet slit 13, indicated by an arrow A in FIG. 1. The recording head 50, is moved in the line direction synchronously with the stoppages driving the intermittent movement of the recording sheet 20.

A control circuit (not shown) is provided on a circuit board 62, which is mounted on a lower inner surface of the housing 11 for controlling the conveyer rollers 71 and the recording head 50. A battery 63 for supplying electric power to the components of the color printer 10, such as the motor and the control circuit, is disposed in a compartment of the housing 11 at a side opposite to the surface with the outlet slit 13.

Figure 2:
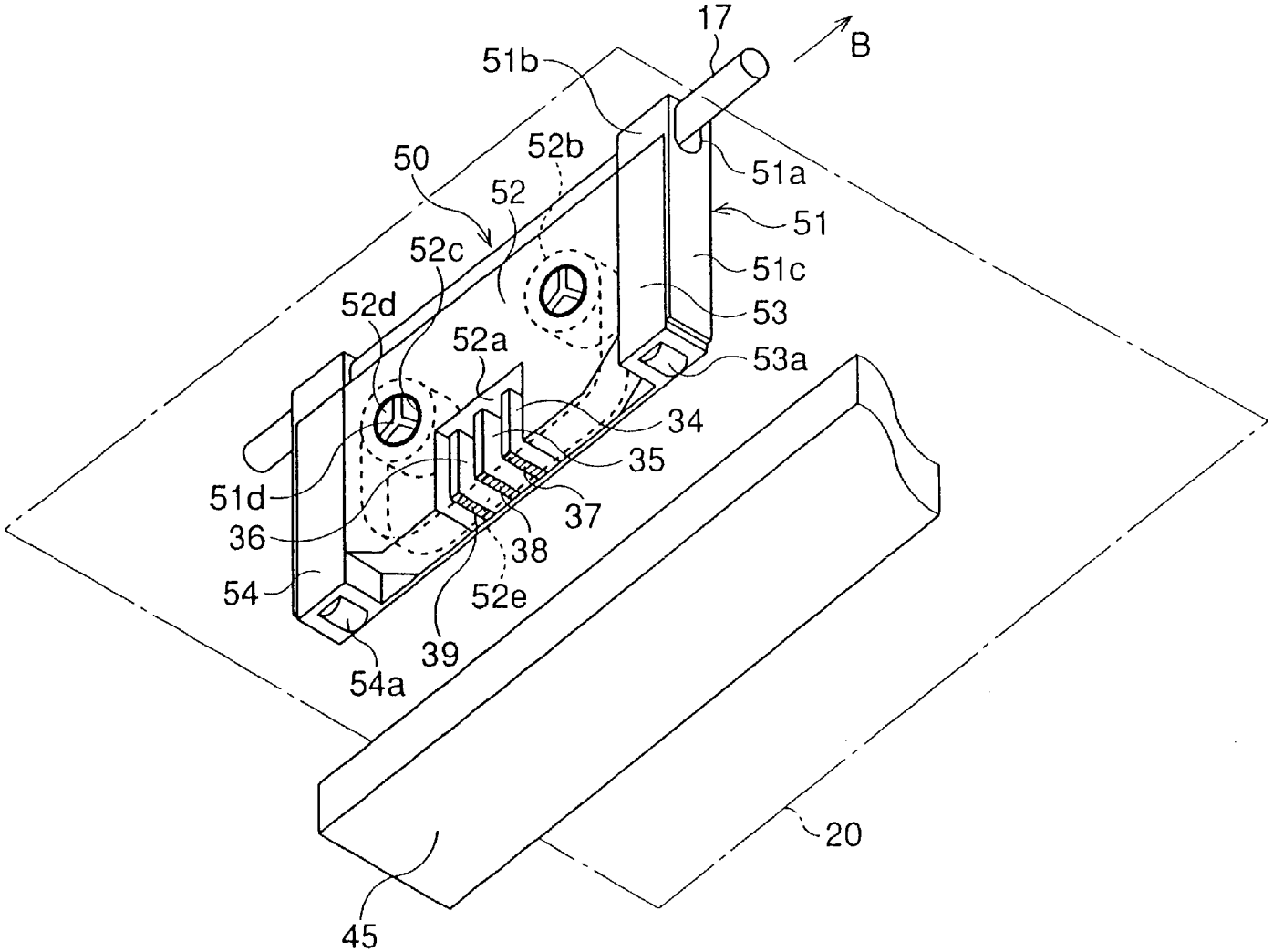
FIG. 2 is a perspective bottom-side view showing a recording head and a horizontal platen of the color printer.
Figure 3:
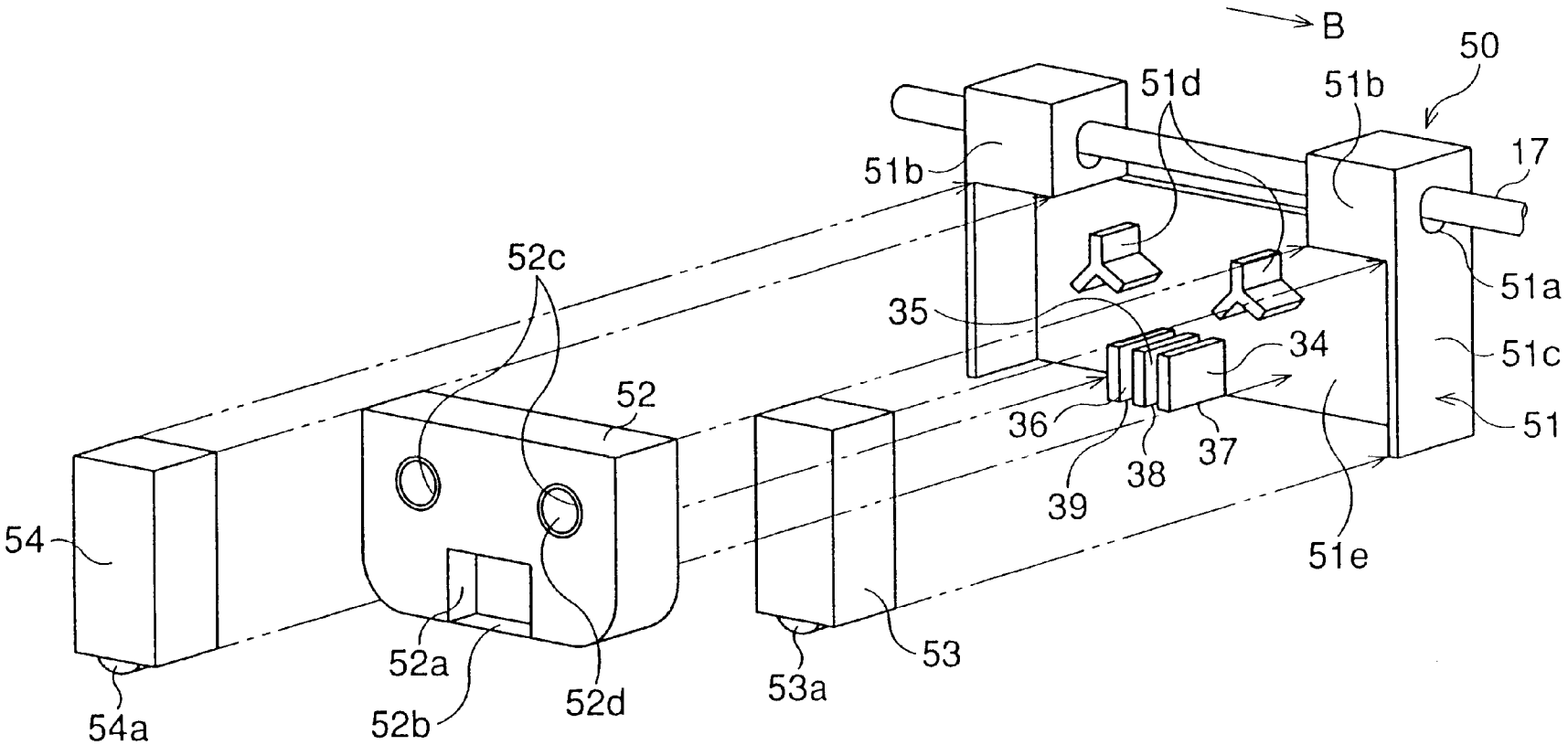
FIG. 3 is a perspective partially-exploded view showing the recording head of the color printer.

A detailed description of the recording head 50 now follows with reference to FIGS. 2 and 3. FIG. 2 shows the recording head 50 and the horizontal platen 45, and FIG. 3 is a perspective partially-exploded view of the recording head 50. The recording head 50 includes a holder 51, a ribbon cassette 52, a pre-coating material container 53 and an over-coating material container 54.

The holder 51 includes a pair of bearing supports 51*b* with the bearings 51*a* disposed therein to which the rail 17 is slidably received, and a pair of ribbon supports 51*c* for holding the ribbon cassette 52 together with the containers 53 and 54. A recess 51*e* is formed by the supports 51*b* and 51*c* within which the cassette 52 and the containers 53 and 54 are detachably mounted. The cassette 52 and the containers 53 and 54 may be formed as independent separate components or as a single unitary component. In this embodiment, it is assumed that the cassette 52 and the containers 53 and 54 are formed as independent separate components.

Thermal heads 34, 35 and 36 are disposed within the recess 51*e* of the holder 51, and have electrically energized heating elements 37, 38 and 39, respectively, facing the conveyer path P and the horizontal platen 45. A pair of spindles 51*d*, on which the cassette 52 is mountable are provided within the recess 51*e* and are rotated in synchronization with the movement of the recording head 50 by a motor (not shown), such as a stepping motor, or the like.

The ribbon cassette 52 is provided with a pair of spools 52*c* having bearings 52*d* which slidably receive respective spindles 51*d*. The spindles 51*d* engage the bearings 52*d*, enabling the spools 52*c* to be driven. A recess 52*a*, formed in a lower side surface of the cassette 52, receives the thermal heads 34, 35 and 36, enabling a ribbon 52*b*, wound off and taken up by the spools 52*c*, to be in close-proximity alignment with the heating elements 37, 38 and 39. The ribbon 52*b* is wound off one of the spools 52*c*, exits through a bottom surface of the cassette 52 through a first opening in the bottom surface wall of the cassette 52, and enters back into the cassette 52 through a second opening coplanar and parallel to the first opening in the bottom surface of the cassette 52, before being taken up by the other spool 52*c*. Reference 52*e* (FIG. 2) shows a portion of the ribbon that passes an opening of the recess 52*a* and comes into close-proximity alignment with the heating elements 37, 38 and 39 when the spindles 51*d* are rotated. The ribbon 52*b* carries micro-capsules filled with dye or ink and will be described in greater detail hereinafter.

Figure 4:
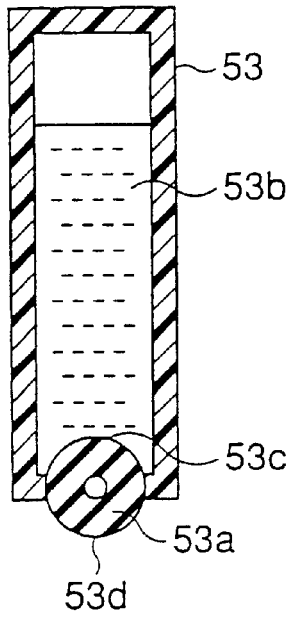
FIG. 4(*a*) is a cross-sectioned elevational view showing a pre-coating material container of the first embodiment.
Figure 4:
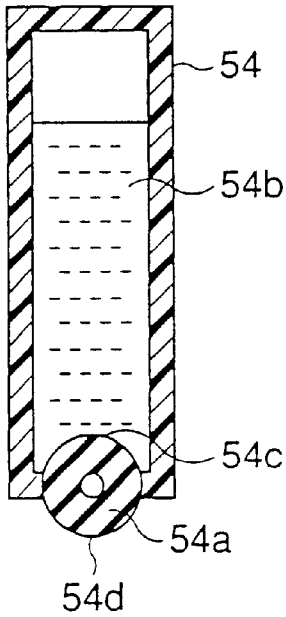

The pre-coating material container 53 is provided with a rotatable roller 53*a* having an axis of rotation perpendicular to the line direction (direction of the movement) of the recording head 50, indicated by an arrow B in FIGS. 2 and 3. The container 53 contains a pre-coating material 53*b* as shown in a sectional view of FIG. 4(*a*). The roller 53*a* is made of a porous material, such as porous rubber or porous ceramic, allowing charging with the pre-coating material 53*b*. The pre-coating material 53*b* is urethane-based or vinyl-based resin solvent that is transparent or colored white and smoothly covers the recording sheet 20 prior to printing. The roller 53*a* contacts the pre-coating material 53*b* contained in the container 53 at an area generally indicated by reference 53*c*. The pre-coating material 53*b* permeates and charges the roller 53*a* at area 53*c* during contact. The pre-coating material is then transferred to the recording sheet 20 by the roller 53*a* rotating outside of the container 53, generally indicated by area 53*d*, formerly being contact area 53*c*.

The over-coating material container 54 is provided with a rotatable roller 54*a* having an axis of rotation perpendicular to the line direction of the recording head 50. The container 54 contains an over-coating material 54*b*. The roller 54*a* is made of a porous material, such as porous rubber or porous ceramic, allowing charging with the over-coating material. The over-coating material is a transparent radiation barrier solution, such as an ultra-violet-cut-off solvent, for over-coating the recording sheet 20 subsequent to printing. An area generally indicated by reference 54*c* of the roller 54*a* contacts the over-coating material contained in the container 54, as shown in a sectional view of FIG. 4(*b*). The over-coating material 54*b* permeates and charges the roller 54*a* during contact inside the container 54, and is transferred to the recording sheet 20 by the roller 54*a* rotating outside of the container 54, generally indicated by area 54*d*, formerly being contact area 54*c*.

Figure 5:
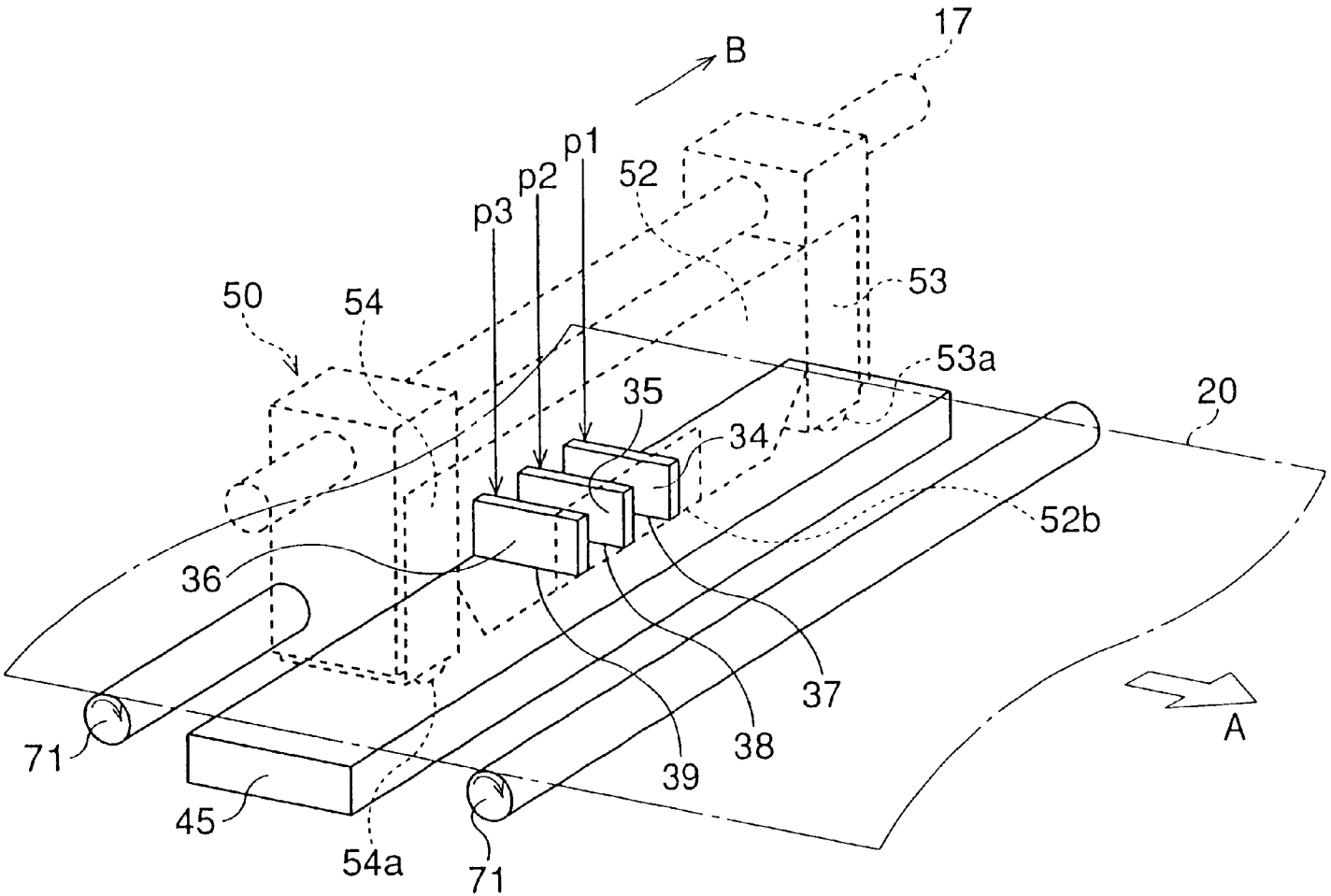
FIG. 5 is a perspective view showing the horizontal platen and a thermal head of the color printer.

A printing operation is now described with reference to FIGS. 2 and 5. FIG. 5 shows the horizontal platen 45 and thermal heads 34, 35 and 36. Addition phantom structures are incorporated to aid visualization and maintain simplicity of illustration.

The recording sheet 20 is inserted between the recording head 50 and the horizontal platen 45. As the recording head 50 is moved in the direction shown by the arrow B, a line of color image is printed due to selective squashing and breaking of micro-capsules on the ribbon 52*b*. Thus, a full-color image is recorded on the recording sheet 20 line by line.

The heating elements 37, 38 and 39 of the thermal heads 34, 35 and 36 exert different pressures p1, p2 and p3, respectively, via spring units (representatively shown as respective arrows p1, p2 and p3 in FIG. 5). The heating elements 37, 38 and 39 are electrically energized by a driving circuit on the circuit board 62 (FIG. 1), which controls the predetermined heating temperatures t1, t2 and t3, respectively. The thermal heads 34, 35 and 36 correspond, for example, to a formation of primary colors: cyan, magenta and yellow, respectively.

The pre-coating material container 53 is positioned at a leading end of the recording head 50, when moving in the direction B. The pre-coat charged roller 53*a* presses against the recording sheet 20, supported by the horizontal platen 45, and rotates due to friction generated with the sheet 20 when the recording head 50 moves in direction B, thus laying down a smooth cover of pre-coating material 53*b* on the recording surface of the recording sheet 20 just prior to printing. The smooth pre-coating prevents smudging or blotting on the recording sheet 20 during printing, by fixing the dye or ink selectively discharged from the micro-capsules.

After the pre-coating by the pre-coating material 53*b*, the recording sheet 20, interposed between the exposed ribbon 52*e* and the horizontal platen 45, contacts the exposed ribbon 52*e* which is in close-proximity alignment with the thermal heads 34, 35 and 36. Consequently, the exposed ribbon 52*e* is locally subjected to pressures p1, p2 and p3 from the thermal heads 34, 35 and 36 pressing the recording ribbon 52*b* onto the recording sheet 20, which in turn is pressed onto the horizontal platen 45. Simultaneously, the exposed ribbon 52*e* is selectively and locally heated to the temperatures t1, t2 and t3 by electrical energization of the heating elements 37, 38 an 39 in accordance with inputted digital image-pixel signals, in this case being digital cyan image-pixel signals, digital magenta image-pixel signals and digital yellow image-pixel signals, to the color printer 10.

The over-coating material container 54 is positioned at a trailing end of the recording head 50, when moving in the direction B. The over-coat charged roller 54*a* also presses against the recording sheet 20 and rotates due to friction generated when the recording head 50 moves in the direction B, thus laying down a cover of over-coating material 54*b* on the recording surface of the recording sheet 20 just subsequent to printing.

At the end of one printing line movement in direction B, the recording head 50 is retracted from the sheet and returned to the initial position of the printing movement as the sheet is advanced by one pitch, being one printing line, downstream, in preparation for a further line printing in accordance with inputted digital image-pixel signals.

As mentioned above, since the recording surface of the recording sheet 20 is smoothed by the pre-coating material 53*b* prior to the printing of the image, the seeped ink or dye is uniformly and neatly fixed on the recording sheet regardless of the condition of the surface of the recording sheet 20. Since the fixed ink or dye is covered with the over-coating material 54*b*, the fixed ink or dye is prevented from discoloration and fading due to ultra-violet radiation, oxidation.

The temperatures t1, t2 and t3 of the heating elements 37, 38 and 39 are set to increase in order, that is, t2 is higher than t1 and t3 is higher than t2. Since the above serial color printer 10 performs a recording operation as the recording head 50 moves in direction B, the temperatures t2 and t3 are readily obtainable by additional heating of the heating elements 38 and 39, respectively, thus making a thermal control of the heating elements 37, 38 and 39 simple. Conversely, the pressures p1, p2 and p3 are set to decrease in order, that is, p2 is lower than p1 and p3 is lower than p2.

If the recording operation is to be performed during movement of the recording head in direction B and also in an opposite direction, the recording head 50 should be pivotally mounted enabling the order of the heating elements 37, 38 and 39 and the position of the containers 53 and 54 to be maintained with respect to a required printing direction of the recording head 50.

Figure 6:
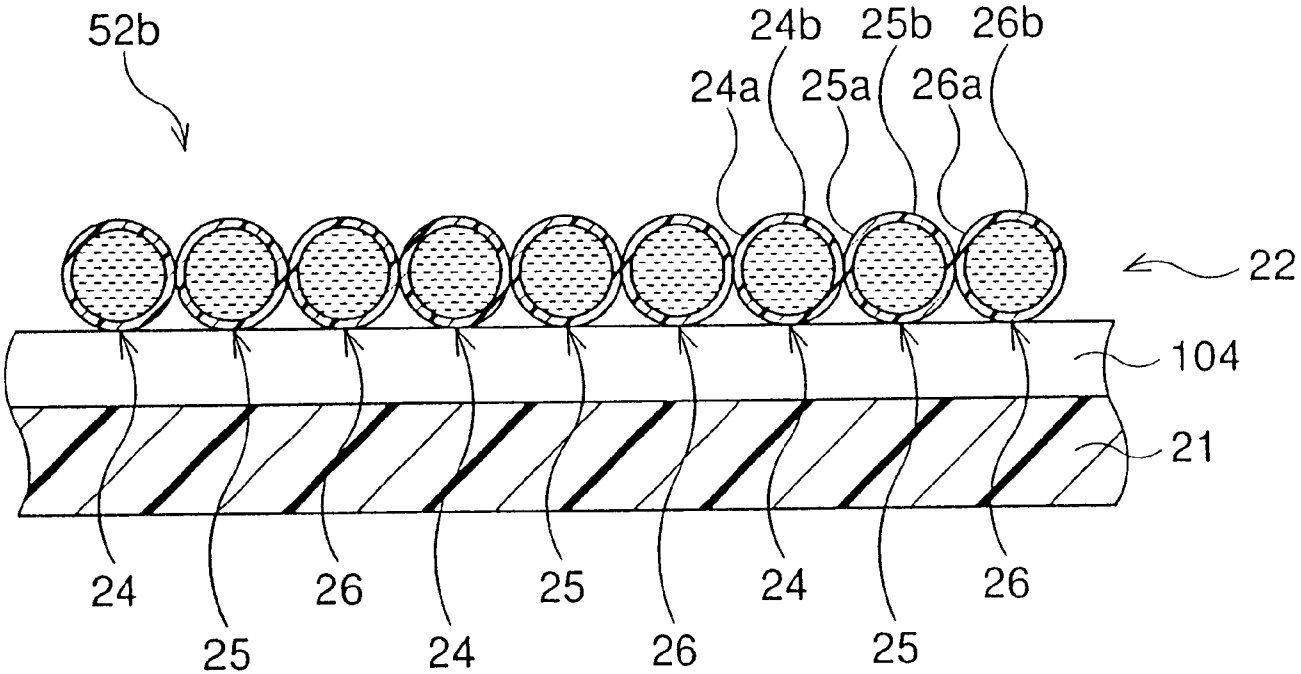
FIG. 6 is a partially-sectioned elevational view showing a structure of a printer ribbon of the color printer.

The ribbon 52*b* used in the pressure-sensitive and heat-sensitive color printer 10 is now described in detail with reference to FIG. 6. FIG. 6 is a cross-sectioned elevational view of the ribbon 52*b*.

The ribbon 52*b* includes a base layer 21 made of, for example, PET-based resin, a capsule layer 22, and a layer of separation material 104 made of, for example, teflon-based resin or silicon-based resin interposed between the base layer 21 and the capsule layer 22.

The separation material 104 improves transferability of the ink or dye to the recording sheet 20 as well as preventing reverse-fixing of the ink or dye on the base layer 21. The capsule layer 22 is formed on the layer of separation material 104, by a well-known material not described herein.

The capsule layer 22 includes three types of micro-capsules 24, 25 and 26, being, in this case, a cyan type of micro-capsule, a magenta type of micro-capsule and a yellow type of micro-capsule, respectively, which are disposed on the layer of the separation material 104 with a suitable binder or fixing material. The ribbon cassette 52 introduces the ribbon 52*b* onto the recording sheet 20 as exposed ribbon 52*e* (FIG. 2) so that the capsule layer 22 contacts the recording sheet 20 during recording.

In FIG. 6, for the convenience of illustration, although the capsule layer 22 is shown as having a thickness corresponding to the diameter of the micro-capsules 24, 25 and 26, in reality, the three types of micro-capsules 24, 25 and 26 may overlay each other, and thus the capsule layer 22 may have a larger thickness than the diameter of a single micro-capsule 24, 25 or 26.

The three types of micro-capsules are described in detail with reference to FIGS. 7, 8 and 9. For a material of each type of micro-capsule (24, 25, 26), a shape memory resin is utilized. For example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinyl-chloride-based resin, a polyester-based resin and so on are also known.

Figure 8:
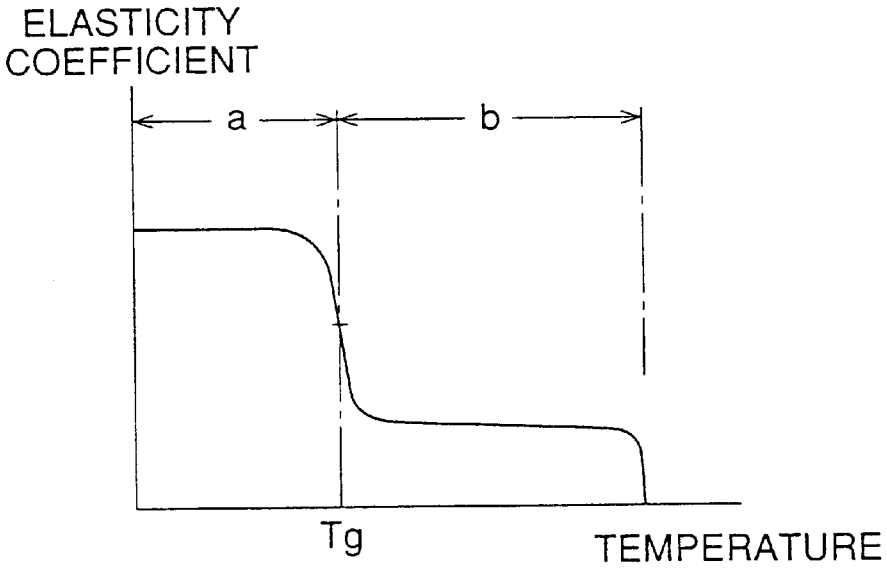
FIG. 8 is a diagram showing a characteristic relationship between temperature and elasticity coefficient of a shape memory resin of the micro-capsules.

In general, as shown in a graph of FIG. 8, the shape memory resin exhibits a coefficient of elasticity, which abruptly changes at a glass-transition temperature boundary Tg. In the shape memory resin, Brownian movement of the molecular chains is stopped in a low-temperature area "a", which is less than the glass-transition temperature Tg, and thus the shape memory resin exhibitsa glass-like phase. On the other hand, Brownian movement of the molecular chains becomes increasingly energetic in a high-temperature area "b", which is higher than the glass-transition temperature Tg, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature Tg, the article becomes freely deformable. After the shaped article is deformed into another shape, when the deformed article is cooled to below the glass-transition temperature Tg, the other shape of the article is fixed and maintained. Nevertheless, when the deformed article is again heated to above the glass-transition temperature Tg, without being subjected to any load or external force, the deformed article returns to the original shape.

In the ribbon 52*b* according to this invention, the shape memory characteristic per se is not utilized, but the characteristic abrupt change of the shape memory resin in the elasticity coefficient is utilized, such that the three types of micro-capsules 24, 25 and 26 can be selectively broken and squashed at different temperatures and under different pressures, respectively.

Figure 9:
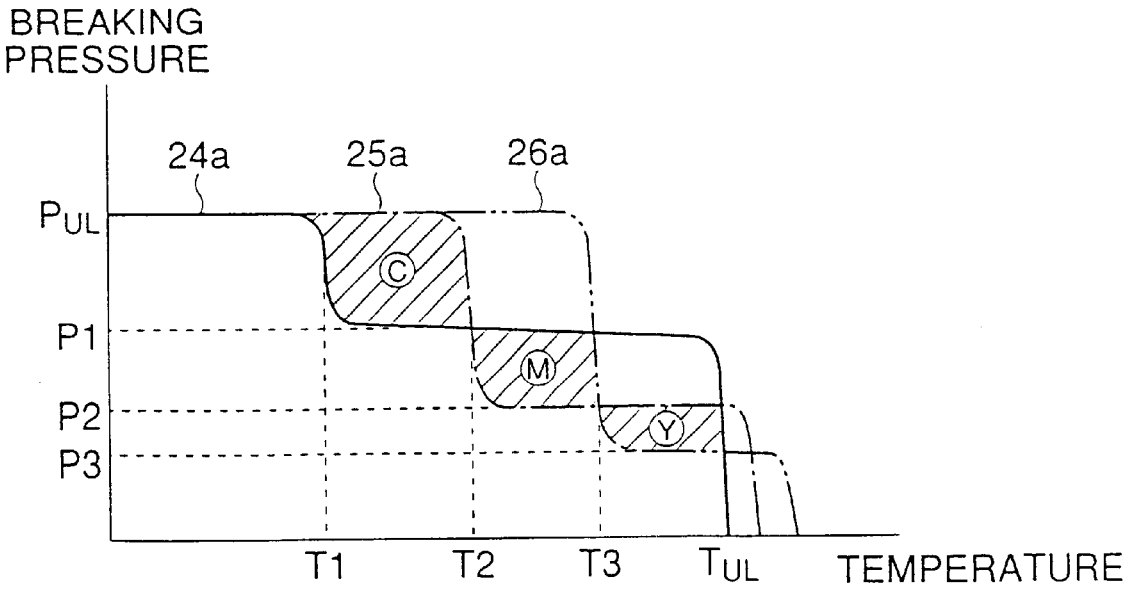
FIG. 9 is a diagram showing a characteristic relationship between temperature and breaking pressure of a capsule wall of the different types of micro-capsules.

As shown in a graph of FIG. 9, a shape memory resin of the cyan micro-capsules 24 is prepared so as to exhibit a characteristic elasticity coefficient, indicated by a solid line, having a glass-transition temperature T1; a shape memory resin of the magenta micro-capsules 25 is prepared so as to exhibit a characteristic elasticity coefficient, indicated by a single-chained line, having a glass-transition temperature T2; and a shape memory resin of the yellow micro-capsules 26 is prepared so as to exhibit a characteristic elasticity coefficient, indicated by a double-chained line, having a glass-transition temperature T3.

Note, by suitably varying compositions of the shape memory resin and/or by selecting a suitable one from among various types of shape memory resin, it is possible to obtain the respective shape memory resins, with the glass-transition temperatures T1, T2 and T3.

Figure 7:
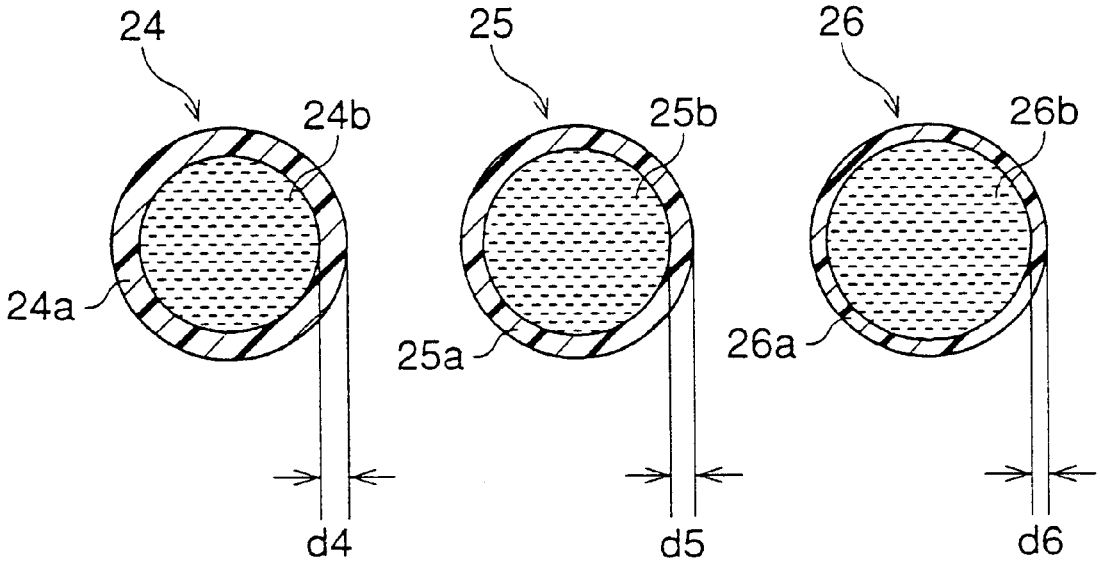
FIG. 7 is a cross-sectional view showing different types of micro-capsule utilized in the first embodiment.

As shown in FIG. 7, the micro-capsule walls 24*a*, 25*a* and 26*a* of the cyan micro-capsules 24, magenta micro-capsules 25, and yellow micro-capsules 26, respectively, have differing thicknesses. The thickness d4 of cyan micro-capsules 24 is larger than the thickness d5 of magenta micro-capsules 25, and the thickness d5 of magenta micro-capsules 25 is larger than the thickness d6 of yellow micro-capsules 26.

Also, the wall thickness d4 of the cyan micro-capsules 24 is selected such that each cyan micro-capsule 24 is broken and compacted under a breaking pressure p1 that lies between a critical breaking pressure P1 and an upper limit pressure $P_{UL}$ (FIG. 9), when each cyan micro-capsule 24 is heated to a temperature t1 between the glass-transition temperatures T1 and T2; the wall thickness d5 of the magenta micro-capsules 25 is selected such that each magenta micro-capsule 25 is broken and compacted under a breaking pressure p2 that lies between a critical breaking pressure P2 and the critical breaking pressure P1 (FIG. 9), when each magenta micro-capsule 25 is heated to a temperature t2 between the glass-transition temperatures T2 and T3; and the wall thickness d6 of the yellow micro-capsules 26 is selected such that each yellow micro-capsule 26 is broken and compacted under a breaking pressure p3 that lies between a critical breaking pressure P3 and the critical breaking pressure P2 (FIG. 9), when each yellow micro-capsule 26 is heated to a temperature t3 between the glass-transition temperature T3 and an upper limit temperature $T_{UL}$.

Note, the upper limit pressure $P_{UL}$ and the upper limit temperature $T_{UL}$ are suitably set in view of the characteristics of the used shape memory resins.

As is apparent from the foregoing, by suitably selecting heating temperatures t1, t2 and t3 and breaking pressures p1, p2 and p3, which should be exerted by the thermal heads 34, 35 and 36 on the ribbon 52*b*, it is possible to selectively break and squash the cyan, magenta and yellow micro-capsules 24, 25 and 26.

For example, the heating temperature t1 and breaking pressure p1 fall within a hatched cyan area C (FIG. 3), defined by a temperature range between the glass-transition temperatures T1 and T2 and by a pressure range between the critical breaking pressure P1 and the upper limit pressure $P_{UL}$, thus only the cyan type of micro-capsule 24 is broken and squashed, thereby seeping the cyan ink or dye 24*b*. Also, the heating temperature t2 and breaking pressure p2 fall within a hatched magenta area M, defined by a temperature range between the glass-transition temperatures T2 and T3 and by a pressure range between the critical breaking pressures P2 and P1, thus only the magenta type of micro-capsule is broken and squashed, thereby seeping the magenta ink or dye 25*b*. Further, the heating temperature t3 and breaking pressure p3 fall within a hatched yellow area Y, defined by a temperature range between the glass-transition temperature T3 and the upper limit temperature $T_{UL}$ and by a pressure range between the critical breaking pressures P2 and P3, thus only the yellow type of micro-capsule 26 is broken and squashed, thereby seeping the yellow ink or dye 26*b*.

Accordingly, when the heating temperature is suitably controlled in accordance with digital color image-pixel signals: digital cyan image-pixel signals, digital magenta image-pixel signals and digital yellow image-pixel signals inputted to the color printer 10, it is possible to form a color image on the recording sheet 20 on the basis of the digital color image-pixel signals.

Thus, by providing the recording head 50 with the pre-coating material container 53 and over-coating material container 54 at positions ahead and behind the cassette, respectively, for pre-coating before and for over-coating after the seepage of the respective ink or dye 24*b*, 25*b* and 26*b* on the recording sheet 20, the full-color image is uniformly and accurately printed and fixed on the recording sheet 20 regardless of the printing surface condition. Due to the protection afforded the image by the over-coating material 54*b* against, for example, ultra-violet radiation, the color of the image can be prevented from deteriorating over many years.

The over-coating material container 54 may be substituted for another pre-coating material container, as required, enabling a further pre-coat to be applied during both forward and reverse one-line printing movements, without the necessity of rotating the recording head.

Figure 10:
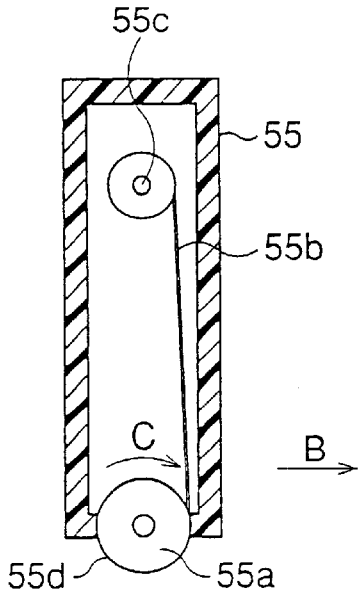
FIG. 10 is a cross-sectioned elevational view showing a pre-coating material container of a second embodiment.

In FIG. 10, a pre-coating material container 55 of a second embodiment is shown, the differences being related only to the pre-coating material container 53 of the first embodiment, and as such description of the other portions are omitted.

The pre-coating material container 55 includes a spool spindle 55*c* around which a film 55*b* is wound, and a low-adhesive roller 55*a* that partially takes up and guides the film 55*b* wound off the spool spindle 55*c*. The axes of rotation of the spindle 55*c* and roller 55*a* are parallel to each other and perpendicular to the line direction (arrow B).

An end of the film 55*b* is temporarily adhered to an outer surface of the roller 55*a* prior to being adhered to the recording sheet 20 when the roller 55*a* rotates in the direction shown by an arrow C due to movement of the recording head 50 (see FIG. 2) in direction B.

An inner surface of the film 55*b* is formed of a polyurethane film or polyvinyl film which is transparent or colored white and on an outer surface 55*d* an adhesive is applied, having a greater adhesive quality than that exhibited by the low-adhesion roller 55*a*, thereby enabling a sure transfer of the film 55*b* from the roller 55*a* to the recording sheet 20. The film 55*b* is in resilient contact with the recording sheet 20 during a printing operation, and as such the adhesive surface 55*d* of the film 55*b* is securely adhered to the recording sheet 20. The surface of the recording sheet thus becomes smooth similarly to the first embodiment.

When the recording head 50 departs from the recording sheet 20 at the end of the one-line printing, the film 55*b*, which exhibits a relatively low tensional resistance, tears leaving a first end portion securely adhered to the recording sheet 20 near a margin area of the recording sheet 20, and a second end portion temporarily adhered to the roller 55*a* before adhesion to the recording sheet 20 in preparation for a next one-line printing. The second end portion is held by about a quarter of a circumference of the roller 55*a*. The film 55*a* may also be constituted as a double film, one film thereof being left on the paper while the other is taken up by a collection system, such as a further roller.

In the second embodiment, similarly to the first embodiment, the types of micro-capsules 24, 25 and 26 are selectively broken by controlled heat and localized pressure, the dye or ink (24*b*, 25*b*, 26*b*) in the broken capsules (24, 25, 26) is discharged and an image is recorded on the recording sheet 20, which may be ordinary paper. A full color image is thus easily recordable. Due to the pre-coating material container 55 provided in the recording head 50, the film 55*b* is accurately transferred to the recording sheet 20, thereby coating the surface of the recording sheet 20, so as to make the recording surface smooth for a printing operation. Therefore, the ink or dye (24*b*, 25*b*, 26*b*) is uniformly transferred and securely fixed on the recording sheet 20 regardless of the surface condition thereof. Consequently the image recorded is fine and precise. Pre-coating by the film 55*b* is advantageous for coating an extremely coarse printing surface. The film pre-coating 55*b* is advantageous over the pre-coating material 53*b* of the first embodiment due to a negation of the undesirable effects of viscosity.

If the one-line printing is to be performed in line direction B and also in the direction opposite line direction B, the recording head 50 is turned so that the position of the container 55 is constantly in the leading position with respect to the movement of the recording head.

Figure 11:
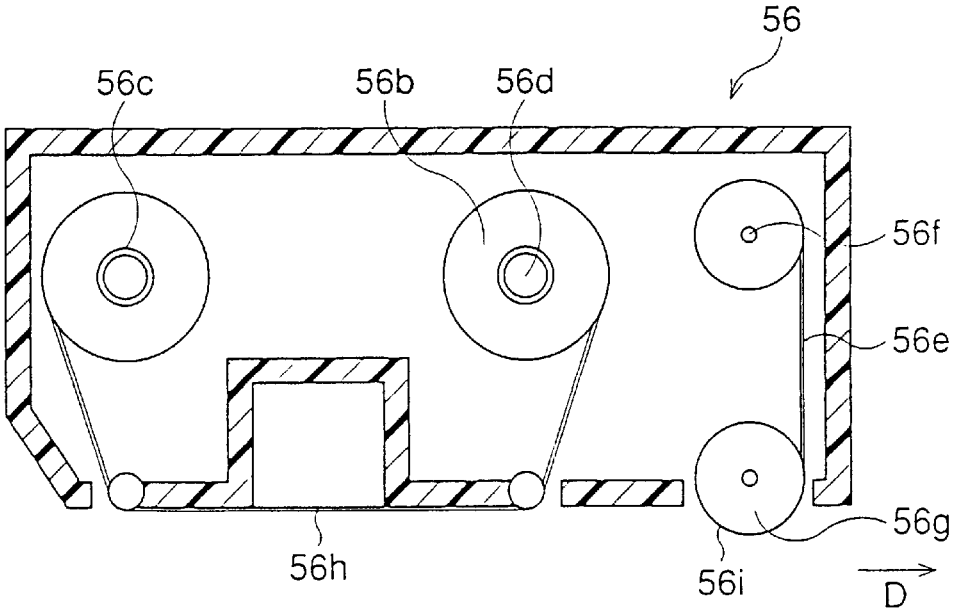
FIG. 11 is a cross-sectioned elevational view showing a mountable ribbon cassette of a third embodiment.

FIG. 11 is a cross-sectioned elevational view of a ribbon cassette of a third embodiment. This embodiment differs from the second embodiment only in that the film 55*b* of the second embodiment (see FIG. 10) is incorporated within the cassette 56. The difference is described, hereinafter. Printing ribbon 56*b*, identical to ribbon 52*b* of the first embodiment, is provided-on a pair of spools 56*c*, which are provided within the cassette 56. Holes 56*d*, provided in the spools 56*c*, respectively, engage spindles 51*d* (FIG. 2). Thus, the ribbon 56*b* is wound off and taken up in a manner identical to the first embodiment, with an exposed portion 56*h* contacting the recording sheet 20.

A film 56*e*, identical to the film 55*b* of the second embodiment, is provided at a leading end of the cassette 56, having a printing direction indicated by an arrow D. The film 56*e*, supported by a spool spindle 56*f*, is supplied to an outside surface 56*i* of a low-adhesive roller 56*g*, and is deposited on the recording sheet 20 similarly to the second embodiment.

The effects and advantages of the third embodiment are similar to those of the second embodiment. It is further possible to provide an over-coating material container, as shown in the first embodiment for over-coating after recording, incorporated into a single cassette in a similar manner as in the third embodiment.

Finally, it will be understood by those skilled in the art that the foregoing description is of preferred embodiments of the device, and that various changes and modifications may be made to the present invention without departing from the spirit and scope thereof.

The present disclosure relates to subject matters contained in Japanese Patent Application No.10-18171 (filed on Jan. 13, 1998) which is expressly incorporated herein, by reference, in its entirety.

What is claimed is:

1. An image transfer apparatus that records an image through selective heat and pressure application, comprising:

an ink transfer unit that includes a layer of micro-capsules containing dye, each micro-capsule disposed in said layer of micro-capsules exhibiting a temperature/pressure characteristic such that, when said each micro-capsule is squashed under a corresponding predetermined pressure at a corresponding predetermined temperature, said dye seeps from said squashed micro-capsule and transfers to a surface of a recording sheet;

a pressure application unit that locally applies said corresponding predetermined pressure to said micro-capsule layer;

a heat application unit that selectively and locally heats said micro-capsule layer to said corresponding predetermined temperature;

a pre-coating unit that pre-coats a material on said surface of said recording sheet prior to said transfer of said dye;

an ink transfer storage unit that stores said ink transfer unit and said pre-coating unit; and a holder that holds said ink transfer storage unit;

wherein a degree of roughness of said surface of said recording sheet is diminished due to said material such that said transferred dye is accurately fixed to said surface as said image.

2. The image transfer apparatus of claim 1, wherein said pre-coating material is a liquid.

3. The image transfer apparatus of claim 1, wherein said pre-coating material is a film fixable to said surface of said recording sheet.

4. The image transfer apparatus of claim 1, further comprising:

an over-coating unit that over-coats a material on said surface of said recording sheet subsequent to said transfer of said dye, wherein said transferred dye is permanently fixed and protected on said surface.

5. The image transfer apparatus of claim 4, wherein said over-coating material protects said transferred dye against at least one of damaging electromagnetic radiation, oxidation.

6. An image transfer apparatus that records an image through selective heat and pressure application, comprising:

an ink transfer unit that includes a layer of micro-capsules containing dye, said layer of micro-capsules exhibiting a temperature/pressure characteristic such that, when a micro-capsule breaks under a predetermined pressure at a predetermined temperature, said dye seeps from said broken micro-capsule and transfers to a surface of a recording sheet, each micro-capsule being breakable at an ambient temperature by a first pressure and being breakable by a second pressure at a predetermined temperature higher than ambient temperature, said first pressure being higher than said second pressure;

a pressure application unit that selectively applies said predetermined pressure to said micro-capsule layer;

a heat application unit that selectively heats said micro-capsule layer to said predetermined temperature;

a pre-coating unit that pre-coats a material on said surface of said sheet prior to said transfer of said dye;

an ink transfer storage unit that stores said ink transfer unit and said pre-coating unit; and a holder that holds said ink transfer storage unit;

wherein a degree of roughness of said surface of said recording sheet is diminished due to said material such that said transferred dye is accurately fixed to said surface as said image.

7. The image transfer apparatus according to claim 6, further comprising a device that simultaneously controls said temperature and pressure.

8. The image transfer apparatus of claim 6, wherein said pre-coating material is a liquid.

9. The image transfer apparatus of claim 6, wherein said pre-coating material is a film fixable to said surface of said recording sheet.

10. The image transfer apparatus of claim 6, further comprising:

an over-coating unit that over-coats a material on said surface of said recording sheet subsequent to said transfer of said dye, wherein said transferred dye is permanently fixed and protected on said surface.

11. The image transfer apparatus of claim 10, wherein said over-coating material protects said transferred dye against at least one of damaging electromagnetic radiation and oxidation.

12. An image transfer apparatus that records an image through selective heat and pressure application, comprising:

an ink transfer unit that includes a layer of micro-capsules containing dye, each micro-capsule disposed in said layer of micro-capsules exhibiting a temperature/pressure characteristic such that, when said each micro-capsule is squashed under a corresponding predetermined pressure at a corresponding predetermined temperature, said dye seeps from said squashed micro-capsule and transfers to a surface of a recording sheet;

a pressure application unit that locally applies said corresponding predetermined pressure to said micro-capsule layer;

a heat application unit that selectively and locally heats said micro-capsule layer to said corresponding predetermined temperature;

a pre-coating unit that pre-coats a material on said surface of said recording sheet prior to said transfer of said dye;

an ink transfer storage unit that stores said ink transfer unit; and a holder that holds said ink transfer storage unit and said pre-coating unit, wherein a degree of roughness of said surface of said recording sheet is diminished due to said material such that said transferred dye is accurately fixed to said surface as said image.

13. The image transfer apparatus according to claim 12, said holder being provided within an apparatus housing.

14. An image transfer apparatus that records an image through selective heat and pressure application, comprising:

an ink transfer unit that includes a layer of micro-capsules containing dye, said layer of micro-capsules exhibiting a temperature/pressure characteristic such that, when a micro-capsule breaks under a predetermined pressure at a predetermined temperature, said dye seeps from said broken micro-capsule and transfers to a surface of a recording sheet, each micro-capsule being breakable at an ambient temperature by a first pressure and being breakable by a second pressure at a predetermined temperature higher than ambient temperature, said first pressure being higher than said second pressure;

a pressure application unit that selectively applies said predetermined pressure to said micro-capsule layer;

a heat application unit that selectively heats said micro-capsule layer to said predetermined temperature;

a pre-coating unit that pre-coats a material on said surface of said sheet prior to said transfer of said dye;

an ink transfer storage unit that stores said ink transfer unit;

a holder that holds said ink transfer storage unit and said pre-coating unit, wherein a degree of roughness of said surface of said recording sheet is diminished due to said material such that said transferred dye is accurately fixed to said surface as said image.

15. The image transfer apparatus according to claim 14, said holder being positioned within an apparatus housing.

* * * * *